US006997168B2

(12) United States Patent
Schueler et al.

(10) Patent No.: US 6,997,168 B2
(45) Date of Patent: Feb. 14, 2006

(54) FUEL SUPPLY SYSTEM FOR INTERNAL COMBUSTION ENGINES WITH IMPROVED FILLING OF THE FUEL LINE

(75) Inventors: Peter Schueler, Leonberg (DE); Thomas Droege, Murr (DE)

(73) Assignee: Robert Bosch GmbH, Stuttgart (DE)

( * ) Notice: Subject to any disclaimer, the term of this patent is extended or adjusted under 35 U.S.C. 154(b) by 158 days.

(21) Appl. No.: 10/182,380

(22) PCT Filed: Jan. 26, 2001

(86) PCT No.: PCT/DE01/00312

§ 371 (c)(1),
(2), (4) Date: Feb. 25, 2003

(87) PCT Pub. No.: WO01/55582

PCT Pub. Date: Aug. 2, 2001

(65) Prior Publication Data

US 2003/0159681 A1 Aug. 28, 2003

(30) Foreign Application Priority Data

Jan. 28, 2000 (DE) ..... 100 03 748

(51) Int. Cl.
*F02M 37/04* (2006.01)

(52) U.S. Cl. ..... 123/497; 123/495; 123/510

(58) Field of Classification Search ..... 123/495, 123/497, 498, 502, 510, 511
See application file for complete search history.

(56) References Cited

U.S. PATENT DOCUMENTS 5,749,345 A 5/1998 Treml

FOREIGN PATENT DOCUMENTS

| | | | |
|---|---|---|---|
| DE | 4426946 | * | 2/1996 |
| DE | 199 29 986 A1 | | 1/2001 |
| WO | WO 88/01346 | | 2/1988 |
| WO | WO 99/01346 | | 1/1999 |

OTHER PUBLICATIONS

WO 91/17355 (Nov. 14, 1991) Bjerendal.*
EPO 0819843A2 (Mar. 7, 1997) Eck.*

* cited by examiner

*Primary Examiner*—Bibhu Mohanty
(74) *Attorney, Agent, or Firm*—Ronald E. Greigg

(57) ABSTRACT

The invention proposes a fuel supply system for internal combustion engines, having a fuel tank (1) and a fuel reservoir (5) disposed therein, having a fuel pump (11), which drives one or more jet pumps (13), each by means of a supply line (21), the jet pumps (13) in turn filling the fuel reservoir (5) with fuel from the fuel tank (1). There is also a fuel line (7), which hydraulically connects the fuel reservoir (5) to the engine. During the starting of the engine, the fuel pump (11) feeds fuel into the fuel line (7), thus improving the starting behavior of the engine.

21 Claims, 8 Drawing Sheets

FUEL SUPPLY SYSTEM FOR INTERNAL COMBUSTION ENGINES WITH IMPROVED FILLING OF THE FUEL LINE

CROSS-REFERENCE TO RELATED APPLICATIONS

This application is a 35 USC 371 application of PCT/DE 01/00312 filed on Jan. 26, 2001.

BACKGROUND OF THE INVENTION

1. Field of the Invention
2. Description of the Prior Art

The invention is based on a fuel supply system for internal combustion engines, having a fuel tank and a fuel reservoir disposed therein, having means for filling the fuel reservoir with fuel from the tank, and having a fuel line that hydraulically connects the fuel reservoir to the internal combustion engine.

Fuel supply systems of this kind are known. The purpose of the fuel reservoir is to assure that the fuel line, which extends into the fuel supply system, aspirates fuel and not air for as long as possible. This is particularly important when the tank is near empty and/or when the vehicle is subject to powerful lateral accelerations so that the contents of the fuel tank are pushed to the side. This effect is achieved in that the fuel reservoir has a relatively small base and a height that corresponds approximately to the height of the fuel tank so that only a relatively small volume of fuel is required to fill the fuel reservoir. This fuel volume is supplied to the fuel reservoir by one or more fuel pumps, which aspirate fuel from the low point(s) of the fuel tank. In order to reduce costs, an electric fuel pump is usually provided inside the fuel reservoir and drives one or more jet pumps disposed in the low point(s) of the fuel tank; the jet pumps supply fuel into the fuel reservoir. This arrangement obviates the need to provide an electric fuel pump in every low point of the fuel tank, which would be expensive and prone to malfunction.

In many internal combustion engines, the fuel is supplied by means of a fuel line, which aspirates in a fuel supply system. The fuel is delivered by a fuel-supply pump directly coupled to the engine. This means that at low speeds of the engine, the fuel-supply pump only has a very low delivery capacity. As a result, the fuel-supply pump aspirates little or no fuel from the fuel supply system, which has a disadvantageous effect on the starting behavior of the engine. This also places heavy loads on the starter and starter battery. This operating behavior is particularly problematic when the fuel tank has been run out of gas, when the vehicle is first filled with fuel at the manufacturer, or at low outside temperatures when the performance of the starter battery is reduced.

The object of the invention is to produce a fuel supply system for internal combustion engines, which improves the starting behavior of the engine even under unfavorable conditions and consequently contributes to reducing the strain on the starter battery and the starter.

This object is attained according to the invention by means of a fuel supply system for internal combustion engines having a fuel tank and a fuel reservoir disposed therein, having means for filling the fuel reservoir with fuel from the fuel tank, and having a fuel line providing a fluid connection between the fuel reservoir and the engine, where the means for filling the fuel reservoir at least sometimes supply fuel into the fuel line.

SUMMARY OF THE INVENTION

In accordance with this invention, the supplying of fuel to the internal combustion engine does not depend solely on the delivery capacity of the fuel-supply pump of the engine; instead, particularly when starting the engine, the means for filling the fuel reservoir can also be used to supply fuel into the fuel line. This assures that fuel travels through the fuel line to the engine in an extremely short time and consequently improves its starting behavior. Since in essence, only already existing components of the fuel supply system are used, the costs for this measure are very low, which is of particular significance in vehicles that are mass-produced.

In one embodiment of the invention, a connecting line is provided between the means for filling the fuel reservoir and fuel line so that the fuel quantity supplied by the means for filling the fuel reservoir can be fed into the fuel line regardless of location and can consequently be adapted to the structural conditions at hand.

In one embodiment of the invention, a pressure-holding valve is disposed between the means for filling the fuel reservoir and fuel line so that the working pressure of the jet pumps is always assured. This also assures that the fuel reservoir is filled with fuel from the fuel tank at all times. The pressure holding valve also at least partially prevents the fuel line from emptying out during times when the engine is not running.

In another embodiment of the invention, a throttle is provided between the means for filling the fuel reservoir and fuel line, thus permitting a definite distribution of the fuel flow delivered by the fuel pump to the jet pumps and the fuel line.

In another advantageous embodiment of the invention, a throttle and a check valve are provided between the means for filling the fuel reservoir and the fuel line so that on the one hand, a definite distribution of the fuel flow delivered by the fuel pump is possible and on the other hand, the fuel line is prevented from emptying out during times when the engine is not running.

Another embodiment of the invention provides that a 3/2-port directional-control valve is disposed between the means for filling the fuel reservoir and the fuel line, that in its first switched position, the directional-control valve connects the means for filling the fuel reservoir to the fuel line and in its second switched position, the 3/2-port directional-control valve connects the means for filling the fuel reservoir to the jet pump(s) so that when needed, the entire delivery capacity of the fuel pump is available for filling the fuel line, which achieves a further improvement in the starting behavior of the engine. On the other hand, the entire delivery capacity of the fuel pump can also be used for filling the fuel reservoir.

Another embodiment of the invention provides that a 3/3-port directional-control valve is disposed between the means for filling the fuel reservoir and the fuel line, that in its first switched position, the 3/3-port directional-control valve connects the means for filling the fuel reservoir to the fuel line, that in its second switched position, the 3/3-port directional-control valve connects the means for filling the fuel reservoir to the fuel line and the jet pump(s), and that in its third switched position, the 3/3-port directional-control valve connects the means for filling the fuel reservoir to the jet pump(s). This embodiment assures that the fuel pump rapidly fills the fuel line; on the other hand, even when the second switched position is reached, the jet pumps in the fuel tank are also driven, thus preventing a reduction of the fuel level in the fuel reservoir.

Another embodiment of the invention provides that the 3/2-port directional-control valve or the 3/2-port directional-control valve is brought into its first switched position in a spring-loaded fashion and that the 2/3-port directional-control valve or the 3/3-port directional-control valve is brought into the second and possibly third switched position, counter to a spring force, through the use of fuel from the means for filling the fuel reservoir. This arrangement assures that after each time that the engine—and therefore also the fuel pump in the fuel supply system—is not in use, the 3/2-port directional-control valve or the 3/3-port directional-control valve is brought into its first switched position so that with the start of delivery by the fuel pump, the fuel line is filled immediately. Because the fuel delivered by the fuel pump actuates the directional-control valves, depending on the pressure level of the fuel delivered by the fuel pump, the spring force, and a throttle that is possibly provided, these directional-control valves travel into the second and possibly third switched position after a particular period of time. This assures that the fuel pump drives the jet pumps shortly after the beginning of fuel delivery and consequently the fuel reservoir is also filled.

Another embodiment of the invention provides that the fill level of the fuel reservoir is maintained at least at the fill level of the tank, independent of the means for filling the fuel reservoir so that the fuel line and the fuel pump never aspirate air and on the other hand, a continuous operation of the fuel pump can be avoided. This permits the fuel pump to be designed for a shorter service life, which contributes to reducing costs and to reducing the amount of energy required to drive the fuel pump.

Another embodiment of the invention provides that the means for filling the fuel reservoir include an electric fuel pump so that the means for filling the fuel reservoir are inexpensive and easy to activate.

Another embodiment of the invention provides that the fuel pump drives at least one jet pump disposed in the vicinity of the low point(s) of the fuel tank in the installation position and that the jet pump(s) feed(s) fuel into the fuel reservoir so that all of the fuel in the fuel tank can be fed into the fuel reservoir in a simple manner.

In another embodiment of the invention, the fuel line has a check valve, which prevents the fuel line from emptying out when the engine is not in use.

BRIEF DESCRIPTION OF THE DRAWINGS

Other advantages and advantageous embodiments of the invention ensue from the following detailed description, taken in conjunction with the drawings, in which.

DESCRIPTION OF THE PREFERRED EMBODIMENTS

Figure 1:
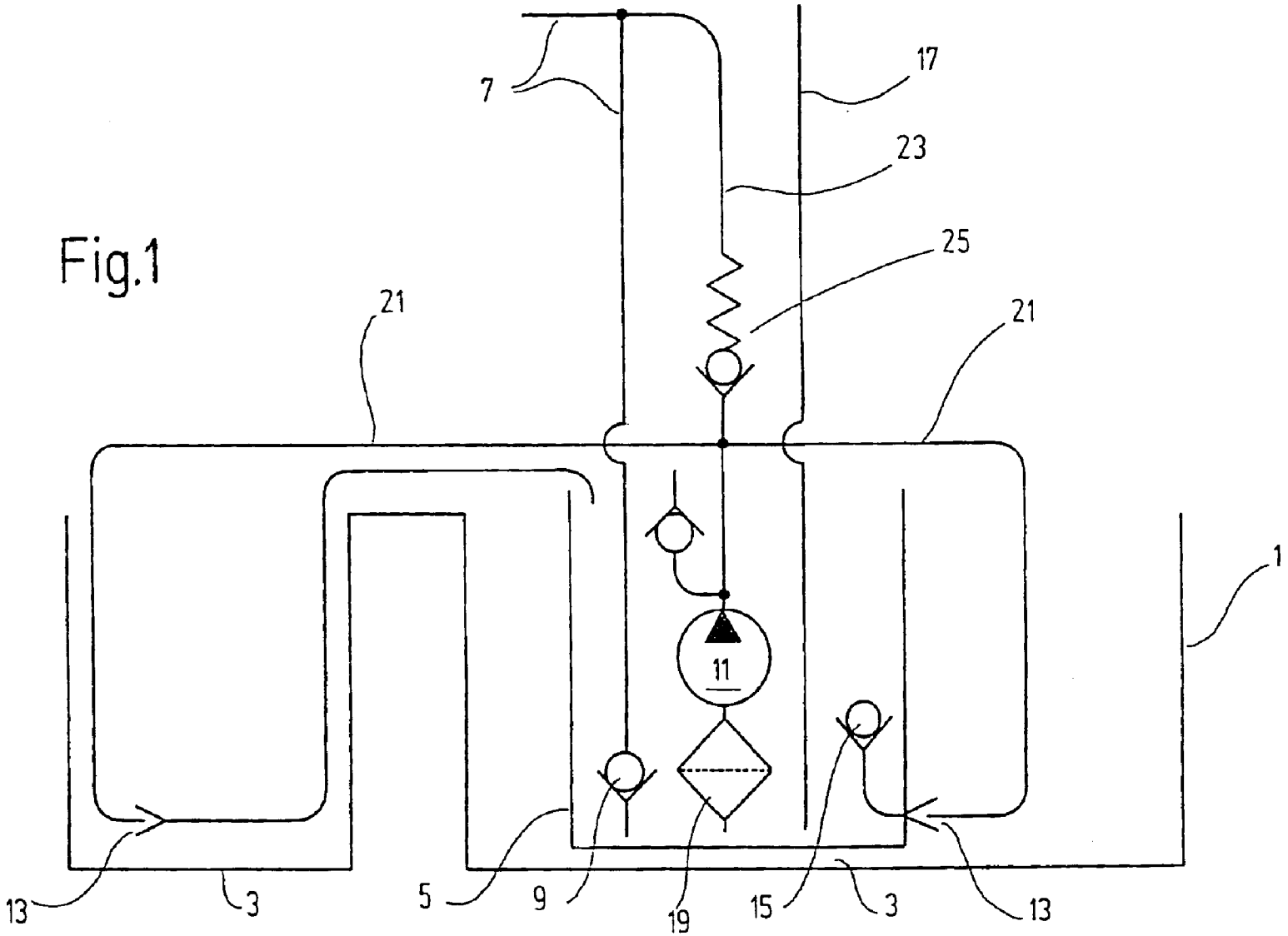
FIG. 1 shows a first exemplary embodiment of a fuel supply system according to the invention, with a pressure-holding valve.

Components that correspond to those in subsequent figures are provided with the same reference numerals; explanations that are given in conjunction with one figure correspondingly apply to the other figures.

FIG. 1 schematically depicts a first exemplary embodiment of a fuel supply system according to the invention, with a pressure-holding valve. A fuel tank 1, the upper half of which is not shown in FIG. 1, has two low points 3. A fuel reservoir 5 that is open at the top is disposed in the fuel tank 1.

The internal combustion engine, not shown, and the associated fuel-supply pump feeds fuel from the fuel reservoir 5 to the engine by means of a fuel line 7 that extends into the fuel reservoir 5. In order to prevent the fuel line 7 from emptying out, a first check valve 9 is provided at its end.

The purpose of the fuel reservoir 5 is to assure that the fuel line 7 aspirates fuel and not air for as long as possible, even when the level of fuel in the fuel tank 1 is low. The fuel reservoir 5 has a much smaller base than the base of the tank 1 and its wall is approximately the same height as the fuel tank 1. This makes it possible to achieve a high fill level in the fuel reservoir 5 with a small quantity of fuel and to consequently assure that the fuel line 7 aspirates fuel for as long as possible.

The fuel reservoir 5 is filled by means which are essentially comprised of a fuel pump 11 and a jet pump 13 in each low point 3 of the fuel tank 1. One of the jet pumps 13 feeds fuel into the lower region of the fuel reservoir 5 and has a second check valve 15, which prevents fuel from flowing back out of the fuel reservoir 5 into the tank 1. When the fuel pump 11 is switched off, the fuel reservoir 5 is filled by means of the check valve 15, as a result of which the fill level in the fuel reservoir 5 is at least approximately the same as the fill level in the fuel tank 1. The other jet pump 13 feeds over the upper rim of the fuel reservoir 5 so that no check valve is required in it.

The fuel tank 1 is fed by a fuel return 17, which conveys excess fuel back to the fuel tank 1. The fuel pump 11 aspirates fuel from the fuel reservoir 5 by means of a preliminary filter 19 and feeds it via supply lines 21 to the jet pumps 13 and via a connecting line 23 into the fuel line 7. In order to assure the pressure required for the jet pumps 13, the connecting line 23 is provided with an overflow valve 25, which is designed so that it only opens when the required working pressure of the jet pumps 13 has been achieved. As soon as the overflow valve 25 opens, part of the fuel delivered by the fuel pump 11 is fed via the connecting line 23 into the fuel line 7. The first check valve 9 in the fuel line 7 also prevents fuel from traveling out of the connecting line 23 and back into the fuel reservoir 5. This arrangement assures that the fuel line 7 is filled with fuel in an extremely short time and consequently permits the engine to be started.

Figure 7:
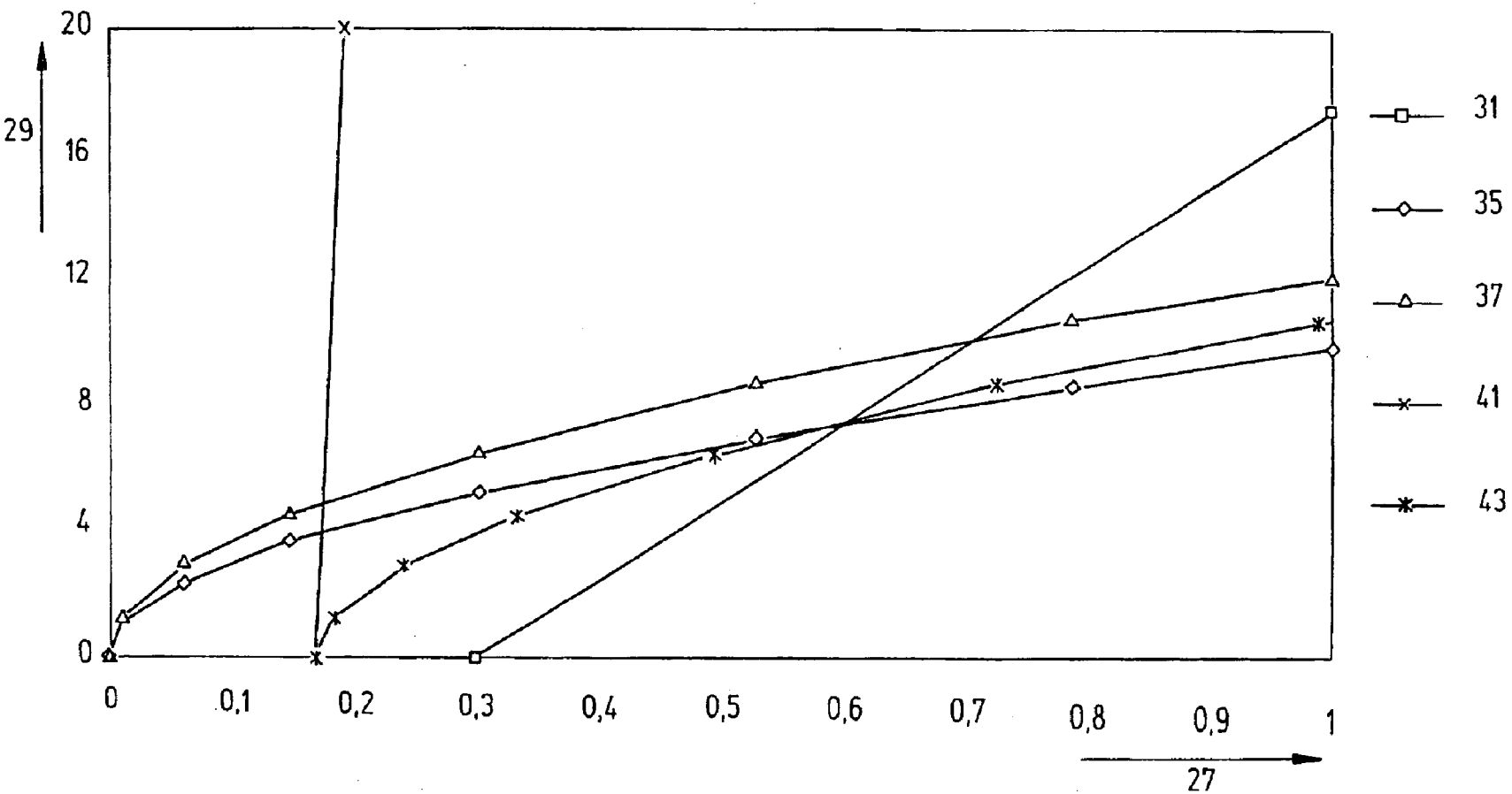
FIG. 7 shows the characteristic curves of the exemplary embodiments according to FIGS. 1 to 3.

FIG. 7 shows a graph of the characteristic curve of this exemplary embodiment according to the invention. The pressure difference in bar is plotted on the abscissa 27, while the ordinate 29 shows the flow rate in liters per hour. The characteristic curve of the first exemplary embodiment is labeled 31. It shows that only after reaching a pressure difference of 0.3 bar does the overflow valve 25 open and the flow rate, beginning from zero, rises in a linear fashion with the increasing pressure difference.

Figure 2:
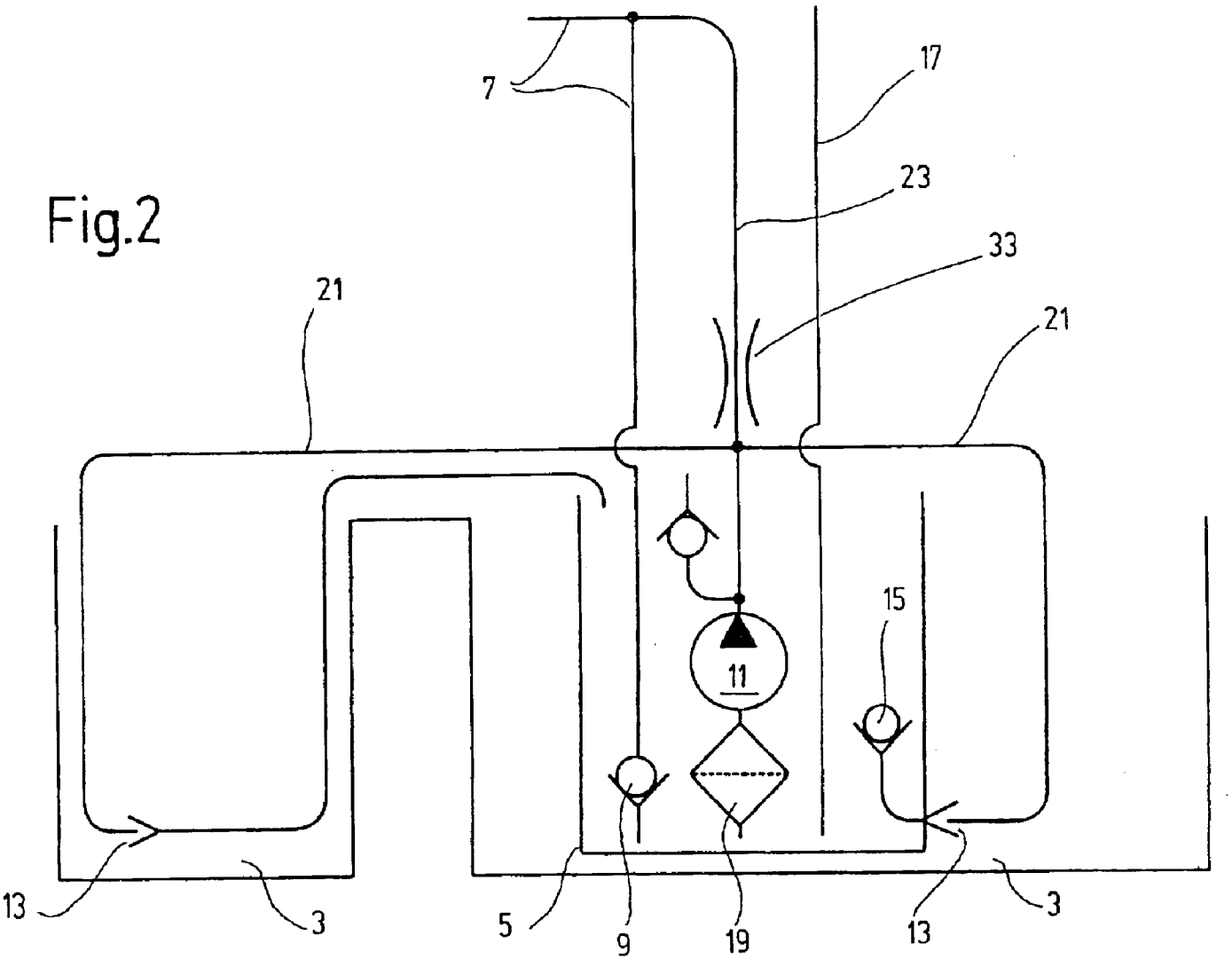
FIG. 2 shows a second exemplary embodiment of a fuel supply system according to the invention, with a throttle.

FIG. 2 shows a second exemplary embodiment of a fuel supply system according to the invention, which in lieu of a pressure-holding valve, has a throttle 33 in the connecting line 23. This produces a characteristic curve that differs from that of the first exemplary embodiment. The characteristic curves 35 and 37 for two different throttle cross sections are plotted in FIG. 7. They show that even with a very slight pressure difference, fuel is already being fed into the connecting line 23 so that the fuel line 7 is filled rapidly. Under unfavorable conditions, the pressure that builds up on the pressure side of the fuel pump 11 can be insufficient to assure the function of the jet pumps 13.

Figure 3:
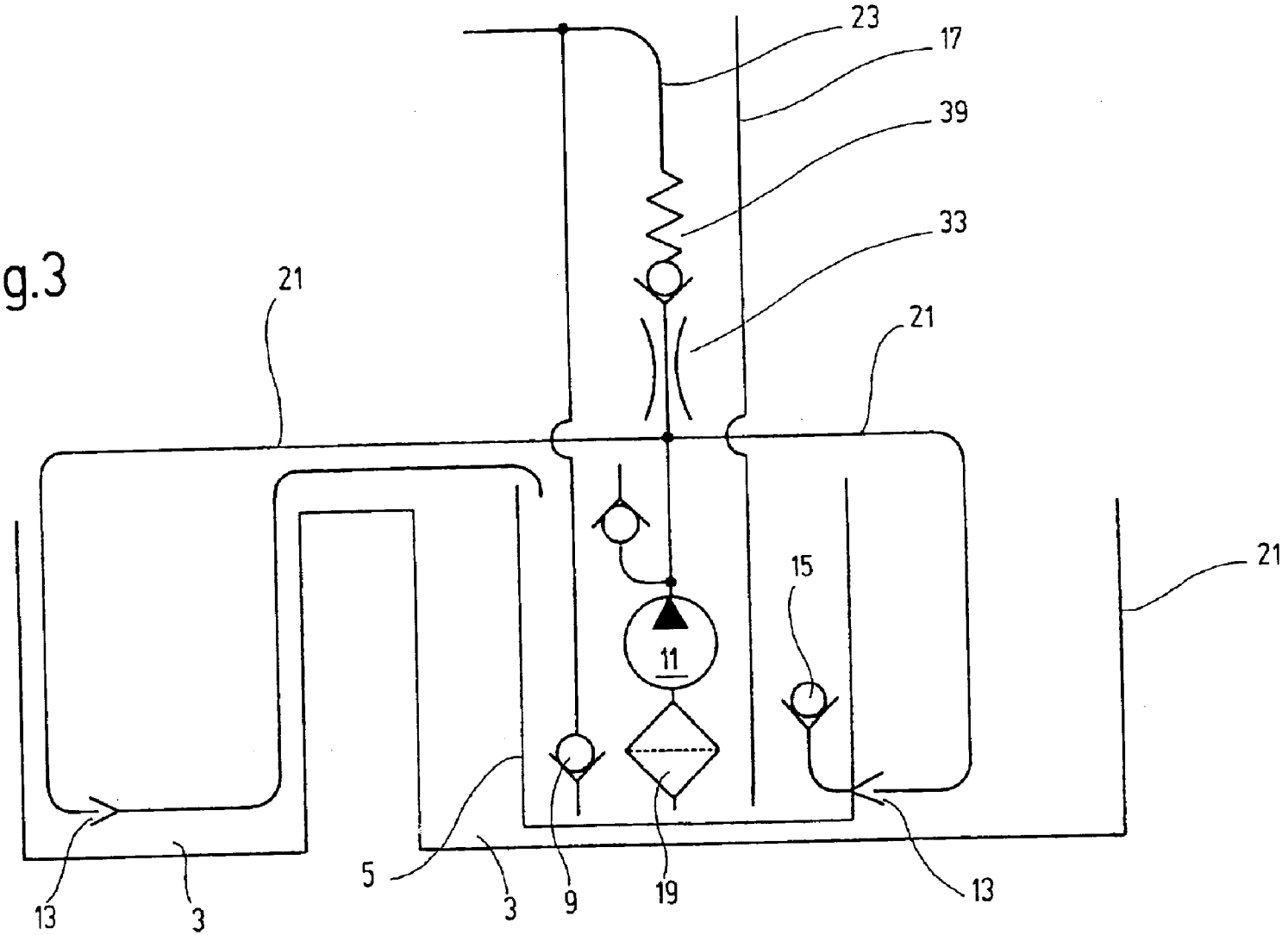
FIG. 3 shows a third exemplary embodiment of a fuel supply system according to the invention, with a throttle and a check valve.

In order to prevent this, in an exemplary embodiment according to FIG. 3, a throttle 33 is combined with a third check valve 39. FIG. 7 shows the characteristic curve 41 of the check valve 39. It shows that when a certain pressure difference is reached, approximately 0.16 bar here, the third check valve 39 opens and the flow rate rises very sharply with increasing pressure difference. The combination of the characteristic curves of the third check valve 39 and the throttle 33 is depicted in FIG. 7 as the characteristic curve 43. This curve shows that in this exemplary embodiment, a certain amount of pressure difference is built up first before the supply pump 11 feeds fuel into the fuel line 7. This improves the operating conditions for the jet pumps 13 and also, the third check valve 39 assures that when the engine is not in use, no fuel flows out of the fuel line 7, through the connecting line 23, and back into the fuel reservoir 5. This assures that the fuel line 7 cannot empty out when the engine is not in use. This also contributes to an improved starting behavior of the internal combustion engine.

It goes without saying that the characteristic curves 31, 35, 37, 41, and 43 from FIG. 7 are only intended as examples of a concrete combination of the fuel pump 11, connecting line 23, overflow valve 25, throttle 33, and/or check valve 39. The quantitative course of the above-mentioned characteristic curves can be varied greatly by changing one or more of these components; the qualitative course of the characteristic curves, however, is retained.

Figure 4:
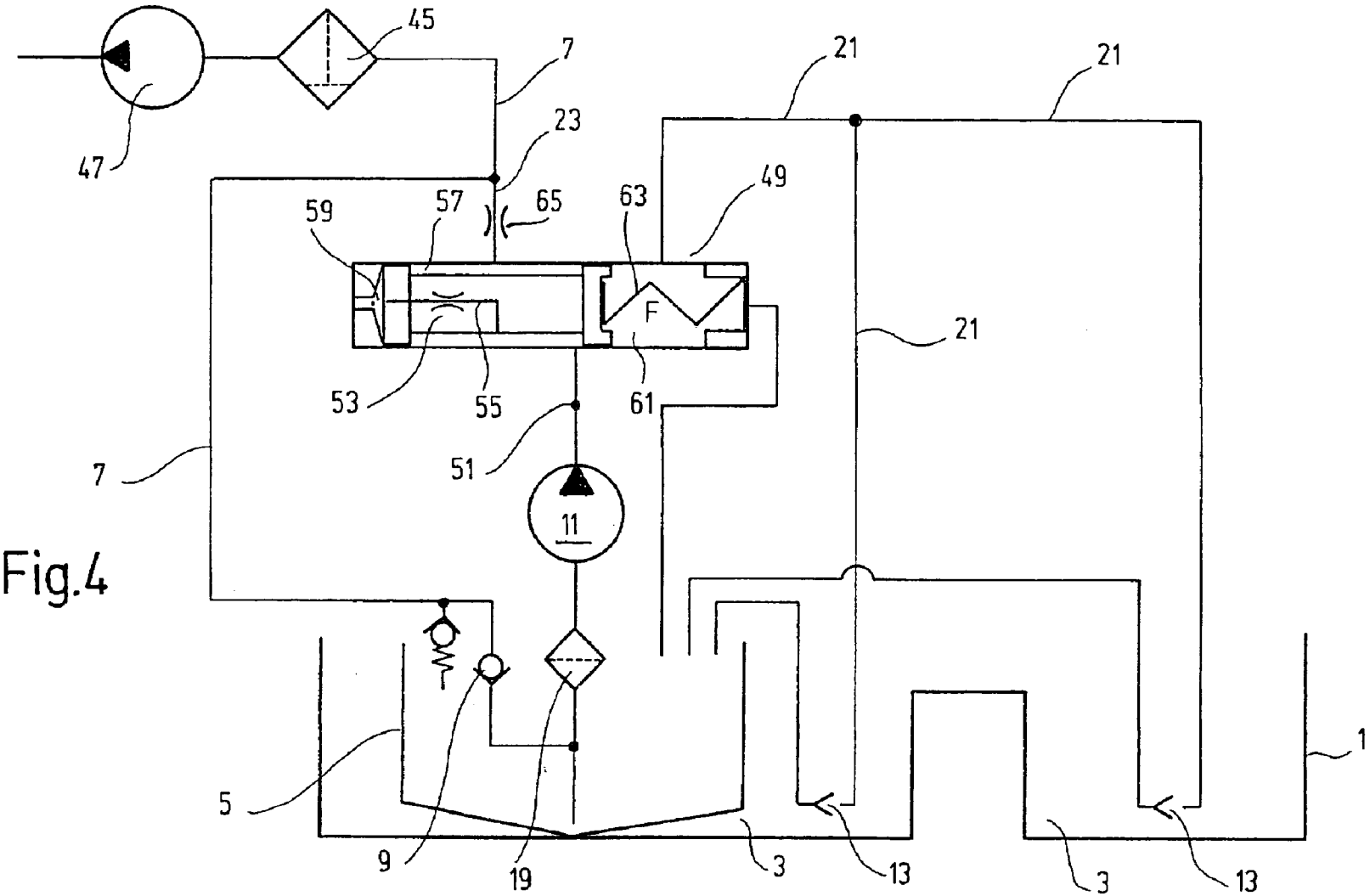
FIG. 4 shows a fourth exemplary embodiment of a fuel supply system according to the invention, with a 3/3-port directional-control valve in a first switched position.
Figure 5:
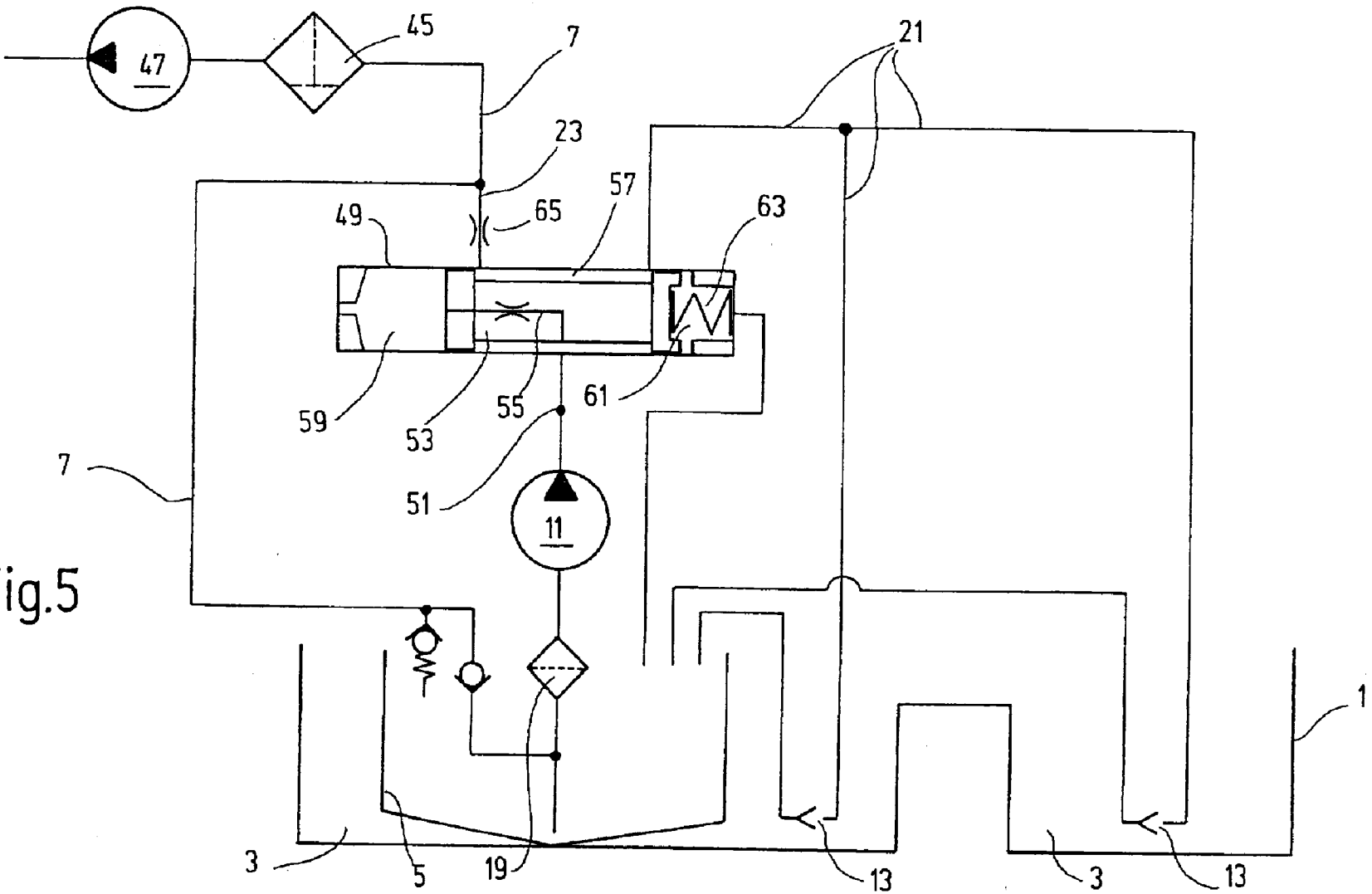
FIG. 5 shows the exemplary embodiment according to FIG. 4 in a second switched position.
Figure 6:
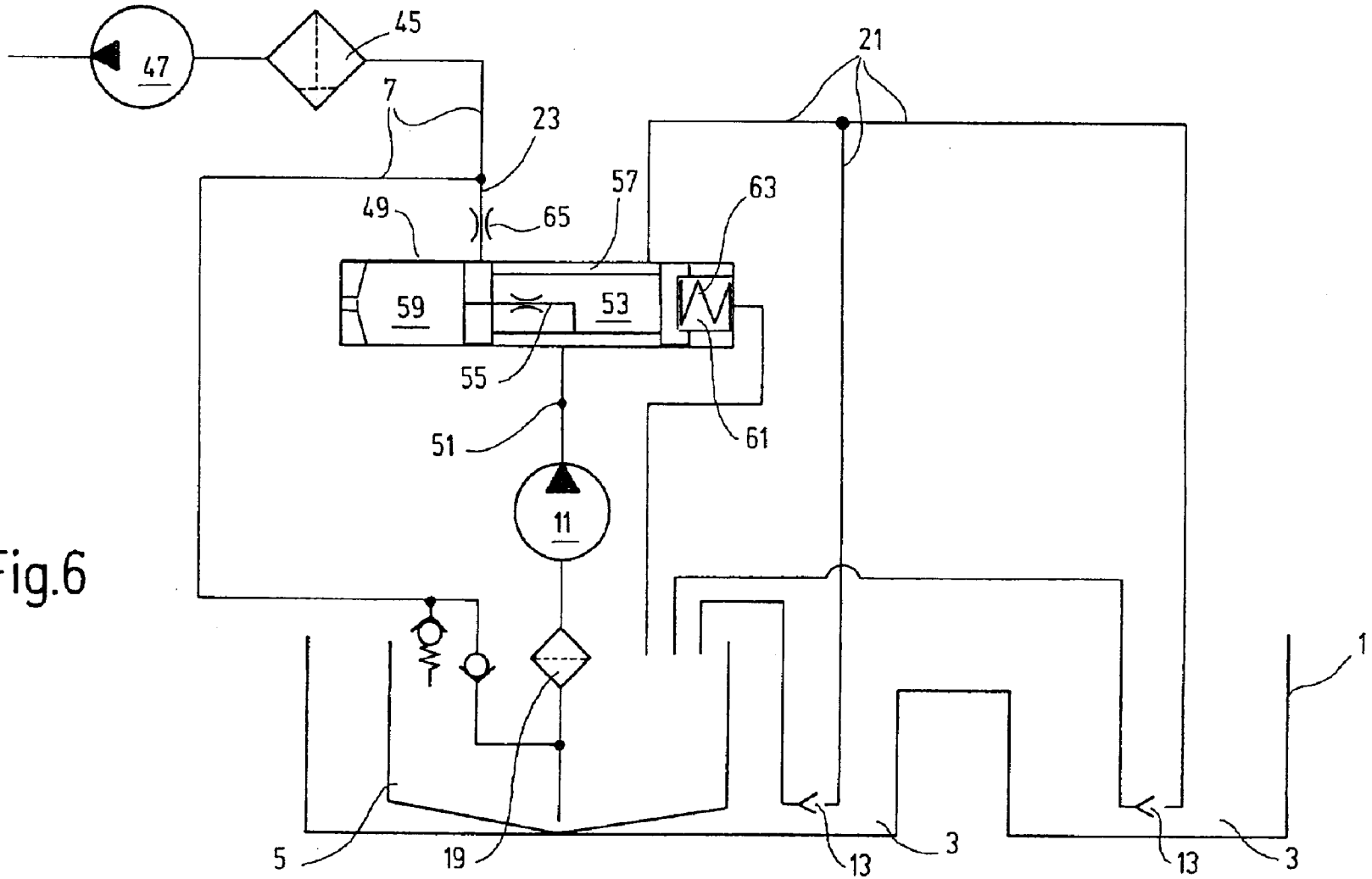
FIG. 6 shows the exemplary embodiment according to FIG. 4 in a third switched position.
Figure 6A:
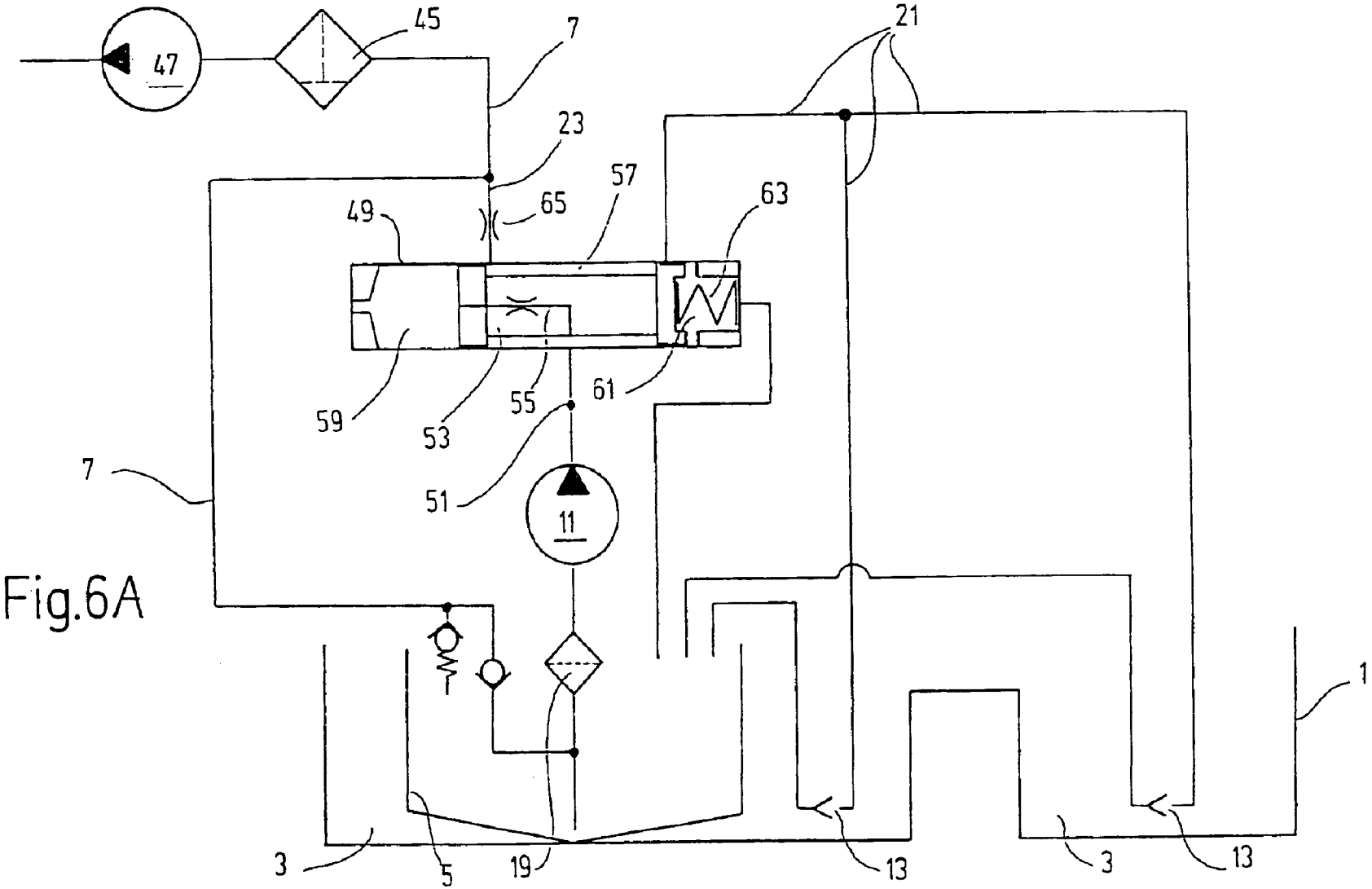
FIG. 6A shows the system of FIG. 4, with a 3/2-port directional-control valve in a switched position corresponding generally to/the third switched position.

FIGS. 4, 5, and 6 show a fourth exemplary embodiment in different operating states. The fuel line 7 has a fuel filter 45 and a fuel delivery pump 47. The fuel fed from the fuel reservoir 5 by the fuel pump 11 is controlled by means of a 3/3-port directional-control valve 49, which is shown in a first switched position. The 3/3-port directional-control valve 49 has a first connection 51, which connects the fuel pump 11 to the 3/3-port directional-control valve 49. A second connection of the 3/3-port directional-control valve 49 is connected to the connecting line 23, while the third connection is connected to the supply line 21.

The 3/3-port directional-control valve has a piston 53. This piston 53 has a connecting bore with a throttle 55, which connects a first chamber 57 of the 3/3-port directional-control valve 49 to a second chamber 59. A third chamber 61 contains a spring 63, which always brings the 3/3-port directional-control valve into the first switched position shown in FIG. 4 when the fuel pump 11 is inoperative.

As soon as the fuel pump 11 is activated, it feeds into the first chamber 57 of the 3/3-port directional-control valve. Since in this switched position, the connecting line 23 is connected to the first chamber 57, the fuel pump 11 feeds into the fuel line 7. A part of the flow stream of the fuel pump 11 travels through the connecting bore with the throttle 55 in the piston 53, and into the second chamber 59, causing the piston 53 to move toward the spring 63, counter to the force of the spring 63.

FIG. 5 shows the fourth exemplary embodiment in a second switched position. The piston 53 is positioned so that the chamber 57 is hydraulically connected to both the connecting line 23 and the supply line 21. In this position, the fuel pump 11 supplies fuel to both the fuel line 7 and the jet pumps 13.

FIG. 6 shows the third switched position of the 3/3-port directional-control valve. In this switched position, the fuel pump 11 only feeds into the supply line 21 and not into the connecting line 23. This means that the entire output of the fuel pump 11 is fed to the jet pumps 13.

FIG. 6 A shows a modification in which a 3/2-port directional-control valve is used in place of the 3/3-port directional-control valve. In this embodiment, the line 23 is closed before the line 21 is opened so that the pump feeds only to line 21.

In this fourth exemplary embodiment, the fuel line 7 is filled as rapidly as possible and at the same time, the jet pumps 13 are driven as soon as possible. As a result, this produces a very favorable starting behavior of the engine, not shown, and it is possible for the fuel pump 11 to be small since it only has to continuously operate to supply the jet pumps 13. Optionally, a throttle 65 can be provided in the connecting line 23, which results in the fact that the fuel flow in the connecting line 23 is reduced and consequently, a greater portion of the fuel flow delivered by the fuel pump 11 flows through the connecting bore 55 into the second chamber 59. This increases the speed with which the piston 53 moves from the first switched position into the third.

All of features shown in the drawings, the specifications, and the claims can be essential to the invention either individually or in arbitrary combinations with one another.

What is claimed is:

1. A fuel supply system for internal combustion engines, comprising, a fuel tank (1) and a fuel reservoir (5) disposed therein, means (11, 13, 21) for filling the fuel reservoir (5) with fuel from the fuel tank (1), and a fuel line (7) that hydraulically connects the fuel reservoir (5) to an engine, the means (11, 13, 21) for filling the fuel reservoir (5) feeding fuel into the fuel line (7) at least part of the time during operation further comprising a 3/2-port directional-control valve disposed between the means (11, 13, 21) for filling the fuel reservoir (5) and the fuel line (7), the 3/2-port directional-control valve in its first switched position connecting the means (11, 13, 21) for filling the fuel reservoir (5) to the fuel line (7), and in its second switched position, the 3/2-port directional-control valve connecting the means (11, 13, 21) for filling the fuel reservoir (5) to the jet pump(s) (13).

2. The fuel supply system according to claim 1, further comprising a connecting line (23) disposed between the means (11, 13, 21) for filling the fuel reservoir (5) and the fuel line (7).

3. The fuel supply system according to claim 1, further comprising an overflow valve (25) disposed between the means (11, 13, 21) for filling the fuel reservoir (5) and the fuel line (7).

4. The fuel supply system according to claim 2, further comprising an overflow valve (25) disposed between the means (11, 13, 21) for filling the fuel reservoir (5) and the fuel line (7).

5. The fuel supply system according to claim 1, further comprising a throttle (33) disposed between the means (11, 13, 21) for filling the fuel reservoir (5) and the fuel line (7).

6. The fuel supply system according to claim 2, further comprising a throttle (33) disposed between the means (11, 13, 21) for filling the fuel reservoir (5) and the fuel line (7).

7. The fuel supply system according to claim 3, further comprising a throttle (33) disposed between the means (11, 13, 21) for filling the fuel reservoir (5) and the fuel line (7).

8. The fuel supply system according to claim 1, further comprising a throttle (33) and a check valve (39) disposed between the means (11, 13, 21) for filling the fuel reservoir (5) and the fuel line (7).

9. The fuel supply system according to claim 2, further comprising a throttle (33) and a check valve (39) disposed between the means (11, 13, 21) for filling the fuel reservoir (5) and the fuel line (7).

10. The fuel supply system according to claim 3, further comprising a throttle (33) and a check valve (39) disposed between the means (11, 13, 21) for filling the fuel reservoir (5) and the fuel line (7).

11. The fuel supply system according to claim 5, further comprising a throttle (33) and a check valve (39) disposed between the means (11, 13, 21) for filling the fuel reservoir (5) and the fuel line (7).

12. The fuel supply system according to claim 2, further comprising a 3/2-port directional-control valve disposed between the means (11, 13, 21) for filling the fuel reservoir (5) and the fuel line (7), the 3/2-port directional-control valve in its first switched position connecting the means (11, 13, 21) for filling the fuel reservoir (5) to the fuel line (7), and in its second switched position, the 3/2-port directional-control valve connecting the means (11, 13, 21) for filling the fuel reservoir (5) to the jet pump(s) (13).

13. The fuel supply system according to claim 2, further comprising a 3/3-port directional-control valve (49) disposed between the means (11, 13, 21) for filling the fuel reservoir (5) and the fuel line (7), the 3/3-port directional-control valve (49) in its first switched position connecting the means (11, 13, 21) for filling the fuel reservoir (5) to the fuel line (7), and in its second switched position, the 3/3-port directional-control valve (49) connecting the means (11, 13, 21) for filling the fuel reservoir (50) to the fuel line (7) and the jet pump(s) (13), and that in its third switched position, the 3/3-port directional-control valve (49) connects the means (11, 13, 21) for filling the fuel reservoir (5) to the jet pump(s) (13).

14. The fuel supply system according to claim 1, wherein the 3/2-port directional-control valve or the 3/3-port directional-control valve (49) is brought into its first switched position in a spring-loaded fashion, and wherein the 3/2-port directional-control valve or the 3/3-port directional-control valve (49) is brought into the second and possibly third switched position, counter to a spring force, by fuel from the means (11, 13, 21) for filling the fuel reservoir (5), which fuel acts as a working medium.

15. The fuel supply system according to claim 1, wherein the fill level of the fuel reservoir (5) is maintained at least at the fill level of the fuel tank (1), independent of the means (11, 13, 21) for filling the fuel reservoir (5).

16. The fuel supply system according to claim 1, wherein the means (11, 13, 21) for filling the fuel reservoir (5) include an electric fuel pump (11).

17. The fuel supply system according to claim 16, wherein the fuel pump (11) drives at least one jet pump (13) disposed in the vicinity of the low point(s) (3) of the fuel tank (1) in the installation position, and wherein the jet pump(s) (13) feed(s) the fuel into the fuel reservoir (5).

18. The fuel supply system according to claim 1, wherein the fuel line (7) has a check valve (9).

19. The fuel supply system according to claim 1, wherein the 3/2-port directional-control valve is brought into its first switched position in a spring-loaded fashion, and wherein the 3/2-port directional-control valve is brought into the second switched position, counter to a spring force, by fuel from the means (11, 13, 21) for filling the fuel reservoir (5), which fuel acts as a working medium.

20. A fuel supply system for internal combustion engines, comprising.

a fuel tank (1) and a fuel reservoir (5) disposed therein, means (11, 13, 21) for filling the fuel reservoir (5) with fuel from the fuel tank (1), and a fuel line (7) that hydraulically connects the fuel reservoir (5) to an engine, the means (11, 13, 21) for filling the fuel reservoir (5) feeding fuel into the fuel line (7) at least part of the time during operation, further comprising a 3/3-port directional-control valve (49) disposed between the means (11, 13, 21) for filling the fuel reservoir (5) and the fuel line (7), the 3/3-port directional-control valve (49) in its first switched position connecting the means (11, 13, 21) for filling the fuel reservoir (5) to the fuel line (7), and in its second switched position, the 3/3-port directional-control valve (49) connecting the means (11, 13, 21) for filling the fuel reservoir (50) to the fuel line (7) and the jet pump(s) (13), and that in its third switched position, the 3/3-port directional-control valve (49) connects the means (11, 13, 21) for filling the fuel reservoir (5) to the jet pump(s) (13).

21. The fuel supply system according to claim 20, wherein the the 3/3-port directional-control valve (49) is brought into its first switched position in a spring-loaded fashion, and wherein the 3/3-port directional-control valve (49) is brought into the second and possibly third switched position, counter to a spring force, by fuel from the means (11, 13, 21) for filling the fuel reservoir (5), which fuel acts as a working medium.

* * * * *